US006305498B1

(12) United States Patent
Itzkovitch

(10) Patent No.: US 6,305,498 B1
(45) Date of Patent: Oct. 23, 2001

(54) SAWHORSE WITH ATTACHED TOOL CARRIER

(75) Inventor: Guy Itzkovitch, New York, NY (US)

(73) Assignee: Zag Industries Ltd., Rosh Ha'Ayin (IL)

( * ) Notice: Subject to any disclaimer, the term of this patent is extended or adjusted under 35 U.S.C. 154(b) by 0 days.

(21) Appl. No.: 09/610,482

(22) Filed: Jul. 5, 2000

(51) Int. Cl.[7] ..... E04G 1/00
(52) U.S. Cl. ..... 182/129; 182/153; 182/155
(58) Field of Search ..... 182/129, 153, 182/155, 178.1, 181.1, 182.2, 186.1, 186.7, 224, 225

(56) References Cited

U.S. PATENT DOCUMENTS

| | | | | |
|---|---|---|---|---|
| D. 317,206 | | 5/1991 | Cagle | D25/68 |
| D. 380,276 | | 6/1997 | Gaona et al. | D25/68 |
| D. 392,746 | * | 3/1998 | Dickinson et al. | D25/67 |
| D. 397,229 | | 8/1998 | Winters et al. | D25/68 |
| D. 410,551 | | 6/1999 | Guimont et al. | D25/68 |
| 2,304,587 | | 3/1942 | Morando | 228/28 |
| 3,563,343 | * | 2/1971 | Kramm | 182/224 |
| 3,637,045 | * | 1/1972 | Poffenbaugh et al. | 182/155 |
| 3,817,349 | * | 6/1974 | Barthel | 182/155 |
| 4,079,679 | * | 3/1978 | Bechtold | 108/132 |
| 4,113,056 | * | 9/1978 | DeLorenzo | 182/153 |
| 4,296,834 | * | 10/1981 | Kroger | 182/155 |
| 4,356,854 | | 11/1982 | McGee | 150/12 |
| 4,375,245 | * | 3/1983 | Schill | 182/155 |
| 4,489,808 | * | 12/1984 | Voye | 182/155 |
| 4,681,187 | * | 7/1987 | Brown | 182/129 |
| 4,726,446 | | 2/1988 | Perbix | 182/46 |
| 4,773,535 | * | 9/1988 | Cook | 206/373 |
| 5,351,785 | * | 10/1994 | DuRapau | 182/153 |
| 5,377,779 | * | 1/1995 | Slapnicka | 182/153 |
| 5,638,915 | | 6/1997 | Hardy | 182/129 |
| 5,647,453 | | 7/1997 | Cassells | 182/129 |
| 5,749,437 | | 5/1998 | Weller | 182/129 |
| 5,813,495 | * | 9/1998 | Smith | 182/155 |
| 5,813,530 | | 9/1998 | Kornblatt | 206/373 |
| 5,971,101 | | 10/1999 | Taggart | 182/129 |
| 5,988,383 | | 11/1999 | Armstrong | 206/373 |
| 6,128,824 | * | 10/2000 | Yang | 33/511 |
| 6,164,413 | * | 12/2000 | Sagol | 182/153 |

* cited by examiner

*Primary Examiner*—Bruce A. Lev
(74) *Attorney, Agent, or Firm*—Pillsbury Winthrop LLP

(57) ABSTRACT

A sawhorse includes a base assembly, a workpiece support structure mounted on the base assembly and an attachment for the base assembly in the form of a tool carrier assembly comprising a flexible carrier sheet, a plurality of tool holding elements affixed to the carrier sheet and a plurality of fasteners fixedly affixing the carrier sheet a support member of the base assembly in a configuration providing access to tools held by the tool holding elements. The tool carrier assembly is positioned such that the assembly is below the support surface to allow the surface to support a workpiece without interference from the assembly and such that the tool carrier assembly does not impede movement of the base assembly between closed and open positions.

18 Claims, 9 Drawing Sheets

SAWHORSE WITH ATTACHED TOOL CARRIER

FIELD OF THE INVENTION

The invention relates in general to sawhorses and, more particularly, to a sawhorse that has a tool carrier member relatively permanently attached to it.

BACKGROUND OF THE INVENTION

Sawhorses are generally used in pairs to support construction-related or carpentry-related workpieces such as boards, planks, pipes, etc. Additionally, sawhorses provide a degree of ground clearance needed for some tools, such as saws, to function properly.

For convenience, construction workers or carpenters keep their tools in a tool carrier of some sort, with which the organization and relatively close proximity of their tools can be maintained, that is laid over or around the top or upper portion of a sawhorse. A tool carrier which covers the sawhorse's top surface can reduce or impede the stability of a workpiece supported on the sawhorse and/or impede opening and closing of the sawhorse on which the tool carrier is placed, and a tool carrier which is draped over the top of a sawhorse is also more likely to be damaged—either by the tools the workman is using of by the workpiece itself. Furthermore, the sawhorse tool carriers known in the prior art are all relatively loosely placed on the sawhorse. Because of this, the tool carrier can fall off the support and become lost relatively easily.

SUMMARY OF THE INVENTION

The present invention avoids these limitations in the prior art by providing a sawhorse that has a tool carrier member relatively permanently attached to one of the support members in a manner which does not obstruct the workpiece support surface or impede opening and closing of the support members.

In preferred embodiments, the sawhorse includes a pair of support members that are pivotally connected at their top ends. The support members can be pivoted into a collapsed storage configuration or spread apart into an open working configuration. At least one foldable cross-brace helps secure the support members in the working configuration.

The tool carrier member has a variety of loops and pockets to hold a worker's tools and is conveniently located on the outside surface of one of the support members. A sawhorse according to the invention has advantages in that, because the tool carrier member is relatively securely attached to the support member, the tool carrier member is not likely to fall off the support member or be lost when the sawhorse is moved. Furthermore, because the tool carrier member does not cover the workpiece supporting surface, it is less likely to be damaged by a tool operating on the workpiece and the workpiece will be more securely supported on the surface.

Additionally, the sawhorse of the invention has a pair of flip-up workpiece restraints that restrict or prevent lateral movement of a workpiece supported on the sawhorse. These restraints also act as guides when sliding a workpiece across the support surface.

The invention also provides a sawhorse comprising a base assembly including a pair of support members each formed from a plastic material, the support members being connected to one another for movement between an open working configuration in which the base assembly is self-supporting in an upright position and a closed storage configuration. A workpiece support structure mounted on the base assembly and defines an upwardly facing support surface for supporting a workpiece when the base assembly is in its self-supporting upright position. An attachment for the base assembly is provided in the form of a tool carrier assembly comprising a flexible carrier sheet, a plurality of tool holding elements affixed to the carrier sheet and a plurality of fasteners fixedly affixing the carrier sheet to one of the pair of support members in a configuration providing access to tools held by the tool holding elements when the base assembly is in the open working configuration thereof. The tool carrier assembly is positioned (a) such that the tool carrier assembly is below the workpiece support surface to allow the support surface to support a workpiece without interference from the tool carrier assembly and (b) such that the tool carrier assembly does not impede movement of the base assembly between its closed storage configuration and its opened working configuration.

DETAILED DESCRIPTION OF THE INVENTION

Figure 1:
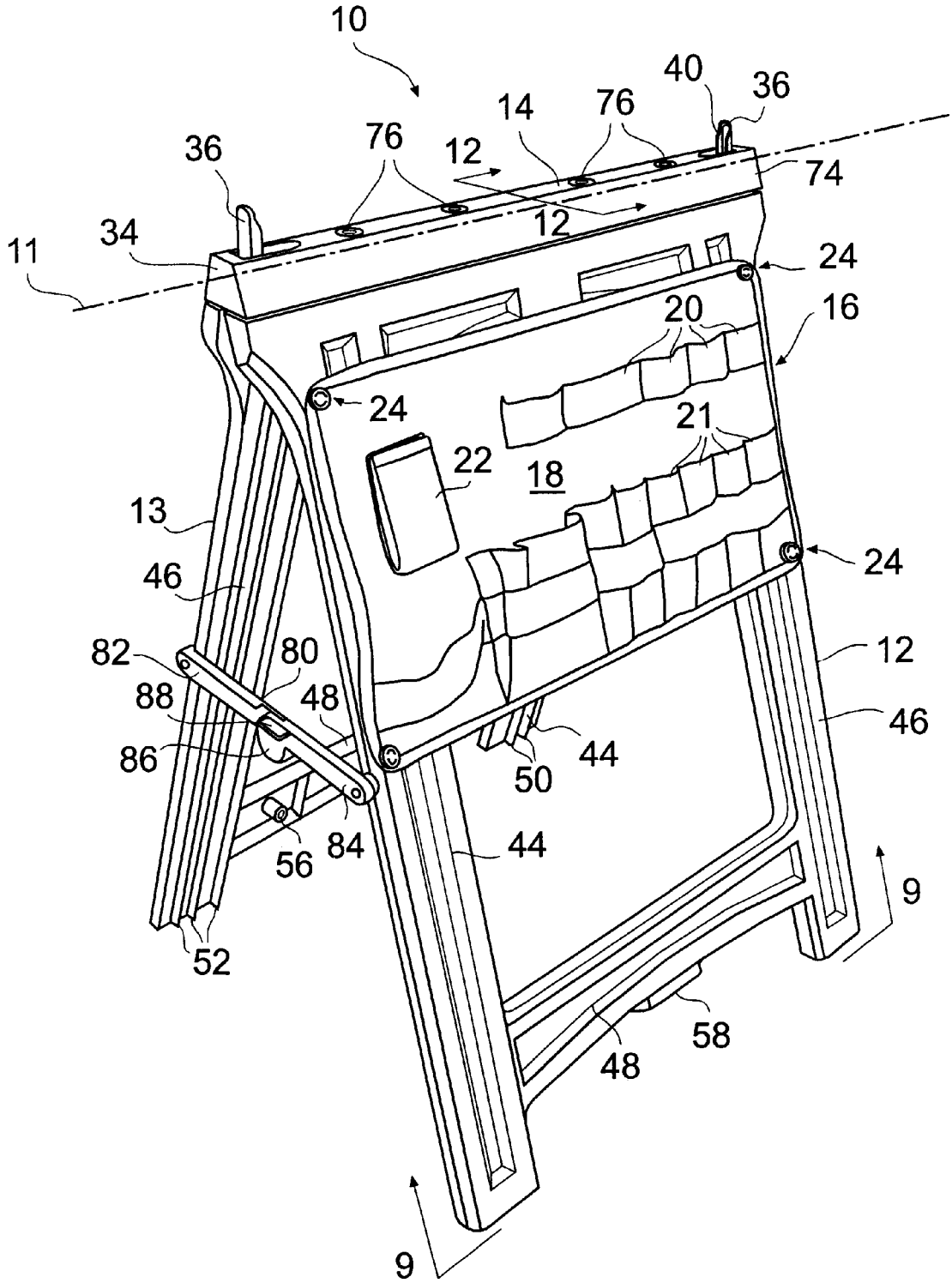
FIG. 1 is a perspective view of a sawhorse of the present invention with the support members in an open working configuration.
Figure 2:
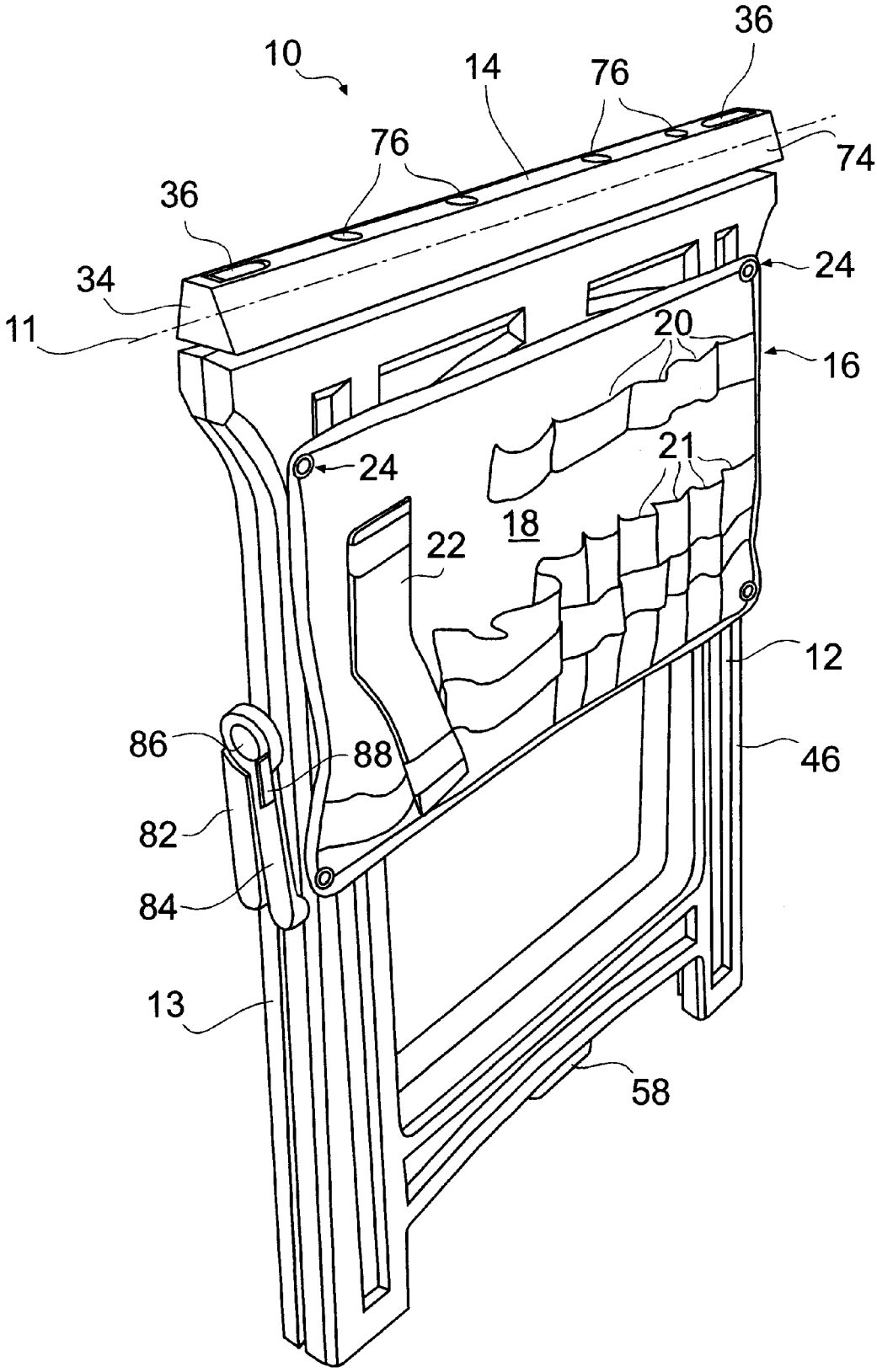
FIG. 2 is a perspective view of the sawhorse illustrated in FIG. 1 with the support members in a closed storage configuration.

FIG. 1 shows a collapsible sawhorse, generally indicated at 10, that has a base assembly that includes a pair of support members 12, 13 that are pivotally connected at their upper ends along a pivot axis 11. An upwardly facing workpiece supporting surface 14 is located generally at the upper ends of the support members 12, 13. FIG. 2 shows the sawhorse 10 in a collapsed or closed storage configuration with the support members 12, 13 generally adjacent to each other.

An attachment for the base assembly is provided in the form of a tool carrier member or assembly 16 that is attached to an outside surface of one of the support members, e.g., 12. The tool carrier member 16 comprises a substantially flat, flexible carrier sheet or base member 18 formed from rugged fabric or material such as canvas or leather. Alternatively, base member 18 may be formed from material such as flexible sheet plastic, nylon, or other rugged, lightweight abrasion-resistant materials. A plurality of tool holding elements in the form, for example, of a number of tool-receiving loops 20 and pockets 21 may be attached to base member 18. For example, tool carrier member 16 includes horizontally arranged, upwardly opening pockets 21, which are attached to the base member 18 along their lower edges. Loops 20 are also horizontally arranged with their respective openings oriented vertically and are attached near an upper edge of base member 18. Another loop 22 can be opened and closed and has a horizontally oriented opening. Shown secured in FIG. 1 and released in FIG. 2, one end of loop 22 is releasably securable by, for example a hook-and-loop connection, indicated at 23, or button fasteners. The tool carrier member 16 may, of course, include any combination of loops 20, 22 and pockets 21 or other tool retaining features.

As shown in FIGS. 1 and 2, the tool carrier member 16 is coextensive with the support member 12 in the widthwise direction (i.e., is approximately the same width as the support member), and it is attached at the corners to the support member 12. The tool carrier member 16 may alternatively be coextensive with the support member 12 in both the longitudinal and vertical directions, i.e., it may have essentially the same height and width of the support member to which it is attached. Still further, each of the support members 12, 13 may have a tool carrier member 16 attached to it if so desired.

Figure 3:
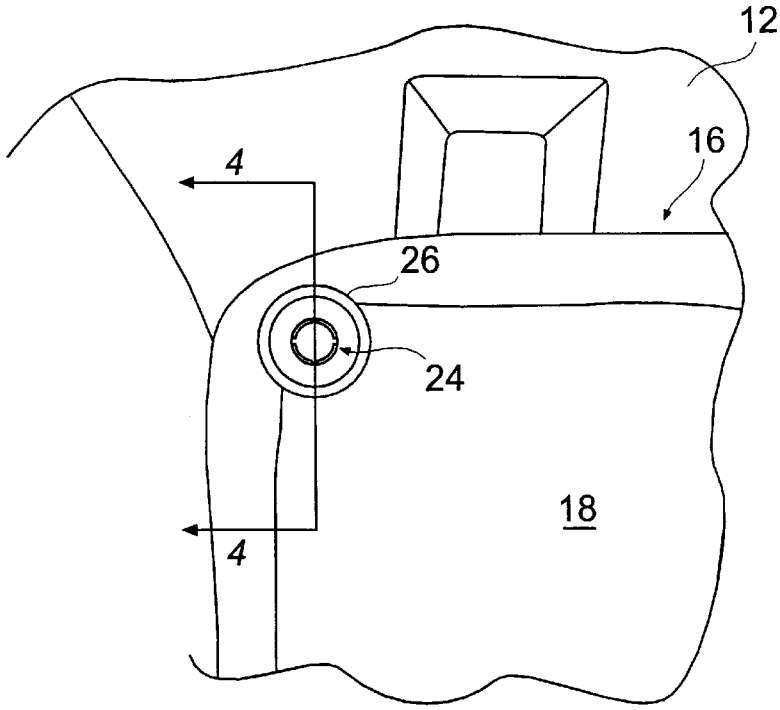
FIG. 3 is a detailed frontal view of the rivet and portions of the tool carrier member and support member of the sawhorse of the present invention.
Figure 4:
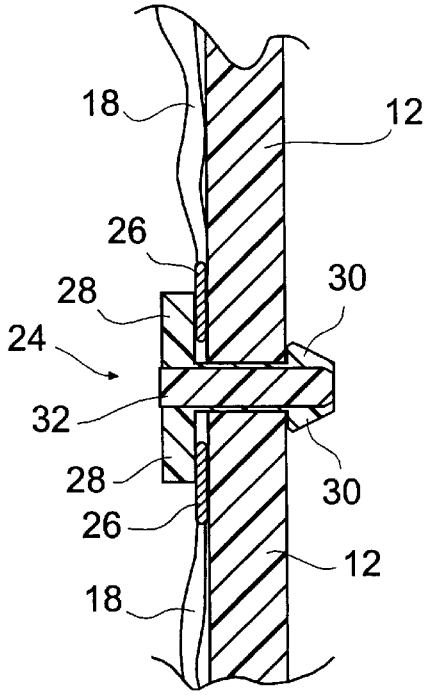
FIG. 4 is a cross-sectional view, taken along line 4—4 in FIG.

As illustrated in greater detail in FIGS. 3 and 4, the tool carrier member 16 is relatively securely attached to one of support members such as the support member 12 using a plurality of fasteners such as plastic rivets 24. Tool carrier member 16 has rivet-receiving openings near each corner, and metallic retaining rings 26 extend through and are crimped around the periphery of each of the rivet-receiving openings to reinforce the openings. Each rivet 24 has a securing head 28, which engages the associated retaining ring 26, and a plurality of ramped retaining prongs 30. As each rivet is pressed into an associated receiving opening, the ramped prongs 30 deflect radially inwardly to pass through the associated mounting opening and then resiliently return to their original positions so as to engage the inner surface of the support member 12 and retain the rivet in the receiving opening. An expansion pin 32 is pressed through the securing head 28 to a position between the ramped prongs 30 and extends substantially along the entire length of the rivet to secure the prongs 30 of rivets 24 in the non-deflected, retaining position. Other means for attaching the tool carrier member 16 to the support member include hook-and-loop connections, with attachment points either at the corners or along the edges of the tool carrier member, and button snaps which may be positioned at the corners and/or spaced along the edges of the tool carrier member 16.

Figure 5:
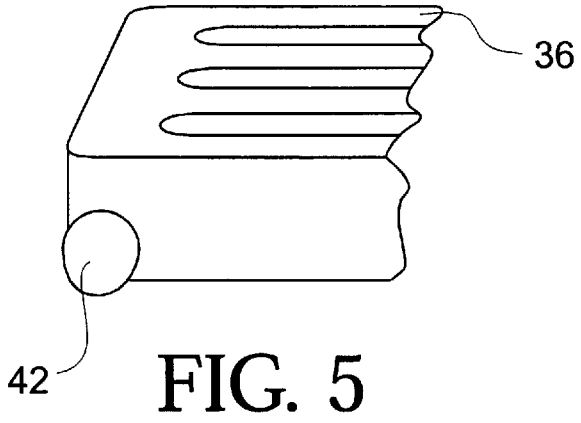
FIGS. 5–7 are a perspective view and side views showing a workpiece restraint used on the sawhorse of the invention.
Figure 6:
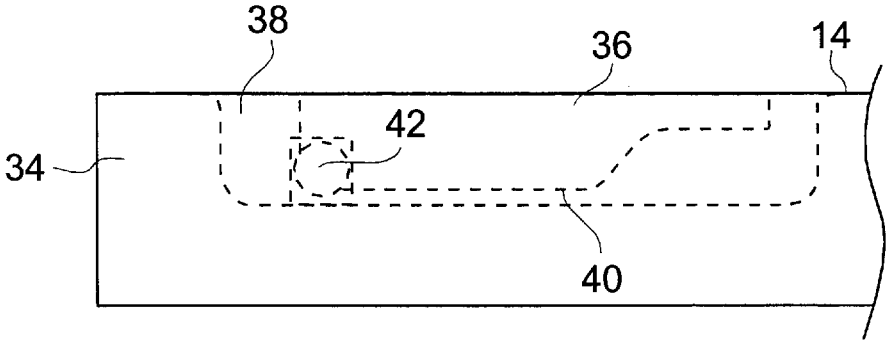
Figure 7:
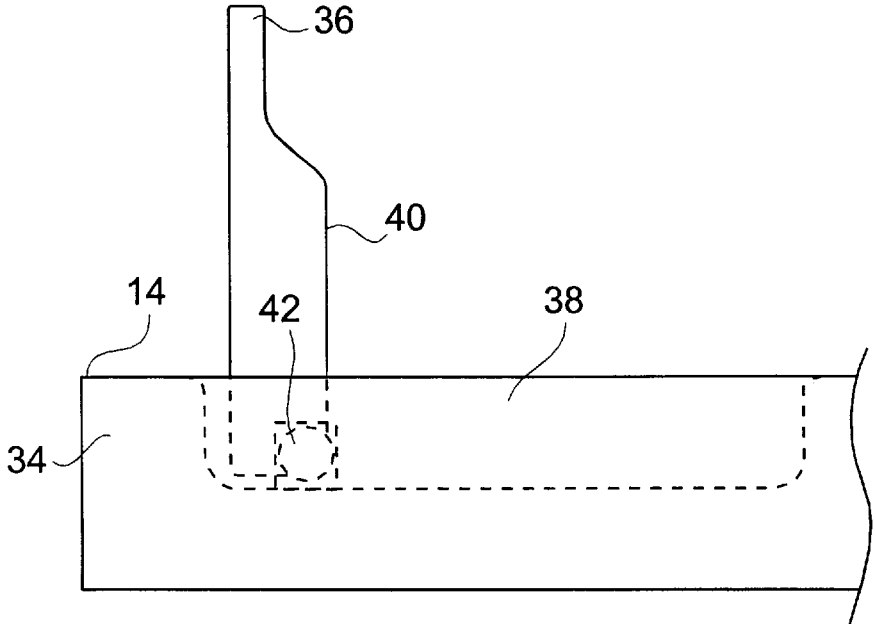

As further shown in FIG. 1, a workpiece support structure or cap member 34 (described in greater detail below) is mounted to the top ends of the support members 12, 13 and forms the upwardly facing workpiece supporting surface or support surface. A pair of flip-up workpiece restraint members or restraints 36, shown in detail in FIGS. 5–7, are pivotally mounted within recesses 38 formed in the cap member 34. The recesses 38 are upwardly facing and are located near opposite ends of the cap member 34. When in a closed position (shown generally in FIG. 2 and in more detail in FIG. 6), the workpiece restraints 36 are located substantially entirely below the workpiece supporting surface 14, such that the workpiece supporting surface 14 is unobstructed. When in an open position (shown generally in FIG. 1 and in more detail in FIG. 7), workpiece restraints 36 extend vertically above workpiece supporting surface 14 such that the workpiece restraints 36 present confronting and longitudinally opposed (i.e., at opposite ends of the cap member 34) vertical restraining surfaces 40. The workpiece restraints 36, and in particular the restraining surfaces 40, serve as guides for workpieces being moved transversely across the workpiece supporting surface 14 and maintain lateral stability of a workpiece supported on the workpiece supporting surface 14.

The workpiece restraints 36 each have a pair of pivot arms 42 extending from the opposite sides of a lower portion (relative to the open position) thereof. Each workpiece restraint 36 is press fit into the associated recess 38, wherein each pivot arm 42 extends into an associated pivot arm-receiving opening formed in an inner surface of the recess 38 to hold the workpiece restraints 36 securely in place. Each pivot arm-receiving opening provides a journaling surface for the associated pivot arm, thereby allowing pivotal movement of the workpiece restraints 36.

Each support member 12, 13 has a pair of vertically extending support legs 44, 46, which are connected to each other by a cross brace 48. Depending on the intended use of the sawhorse 10, i.e., how much weight it will be required to support, the support members 12, 13 may have more than two support legs and may be connected to each other by two or more cross braces.

Figure 8:
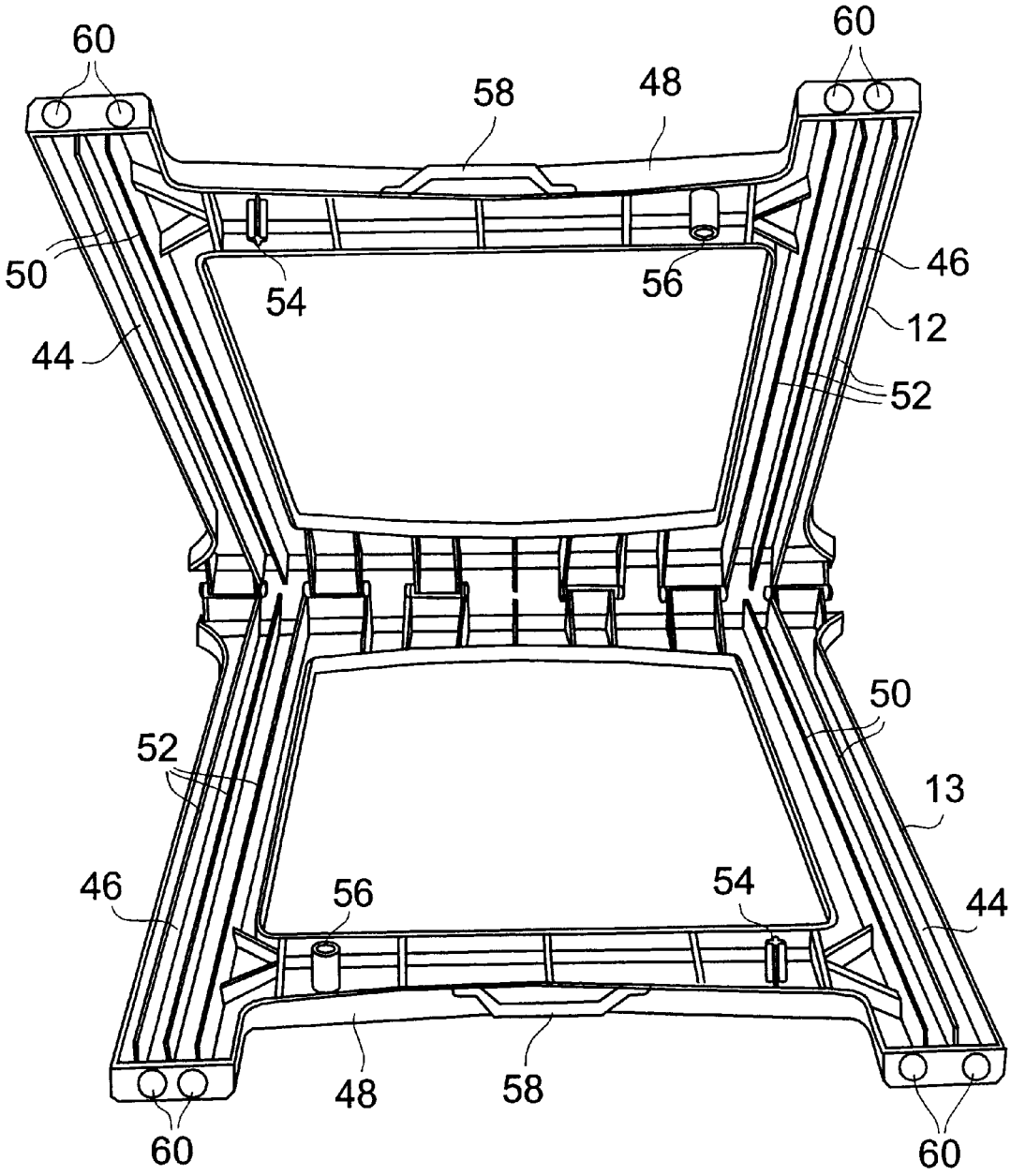
FIG. 8 is a bottom view of the sawhorse shown in FIG. 1.

As shown in FIG. 8, it is preferable for the support members 12, 13 to be identical. By forming the support members identically, mating or associated features or elements (described in greater detail below) may be formed at opposite sides of a given support member so as to confront or engage the respective mating or associated features on the other support member automatically when the support members are brought together, as shown in FIG. 2. This identity of the support members also simplifies production and assembly of the sawhorse and reduces costs.

Figure 9:
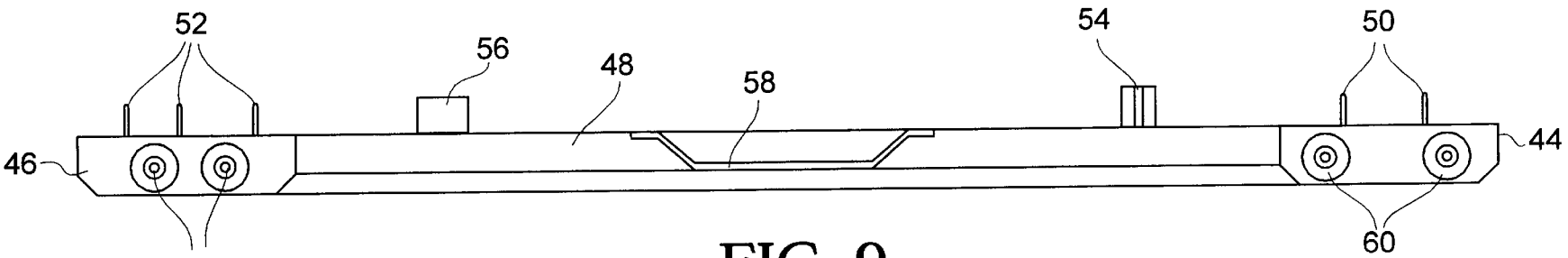
FIG. 9 is an end view of one of the support members, taken along the line 9—9 in FIG. 1.

In particular, a pair of reinforcing ribs 50 extend along the length of the inside surface of each support leg 44—as shown in FIG. 9, the reinforcing ribs 50 may be spaced so as to divide the width of the support leg 44 into generally equal dimensions—and a plurality of reinforcing ribs 52 extend along the length of the inside surface of the other support leg 46 of each support member. The relative spacing of the reinforcing ribs 50, 52 on the support legs of each support member 12, 13 is such that when the support members 12, 13 are in the collapsed position, the converging ribs 50, 52 fit easily between each other.

A sawhorse 10 according to the invention further preferably includes a two-piece latch member. More particularly, each support member 12, 13 has a bayonet pin portion 54 and a barrel portion 56 extending inwardly from the cross brace 48 at opposite ends thereof. As shown in FIGS. 8 and 9, each bayonet pin 54 engages the associated barrel portion 56 upon convergence of the support members 12, 13 when moving support members 12, 13 to the collapsed position. (Again, the identity of the support members 12, 13 facilitates this engagement.) A press fit between the bayonet pins 54 and the associated barrel portions 56 retains the support members in the collapsed position for storage.

Another option (not shown) for retaining the support members in the collapsed position includes a hook-and-eyelet latch. Preferably, the sawhorse would have one or two such hook-and-eyelet latches. One support member, e.g. 12, would have a hook member extending toward the other support member, which would have an eyelet member that the hook member would engage when the sawhorse is in the stored configuration. A hook-and-loop latch may also be utilized to retain the support members 12, 13.

Each cross brace 48 has a handle portion 58 extending downwardly to allow a user to disengage the latch members and open the support members 12, 13 to the working position more easily. A plurality of non-skid members in the form of a pair of floor-engaging pads 60 made from a frictional, non-skid material (for example, rubber) are attached to lower ends of each of the support legs 44, 46.

Figure 10:
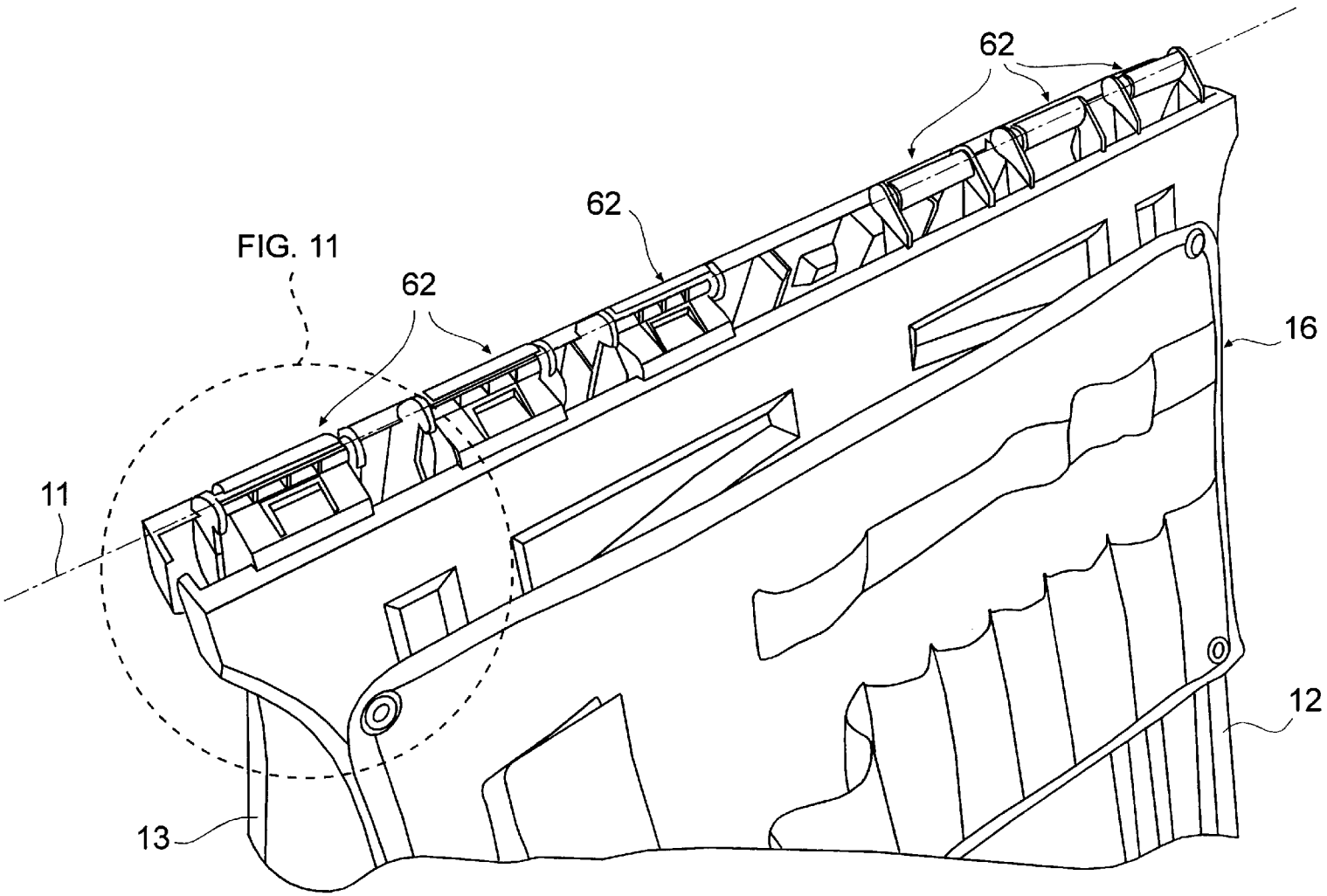
FIG. 10 is a perspective view of the upper portion of the sawhorse shown in FIG. 1, shown with the cap member removed.
Figure 11:
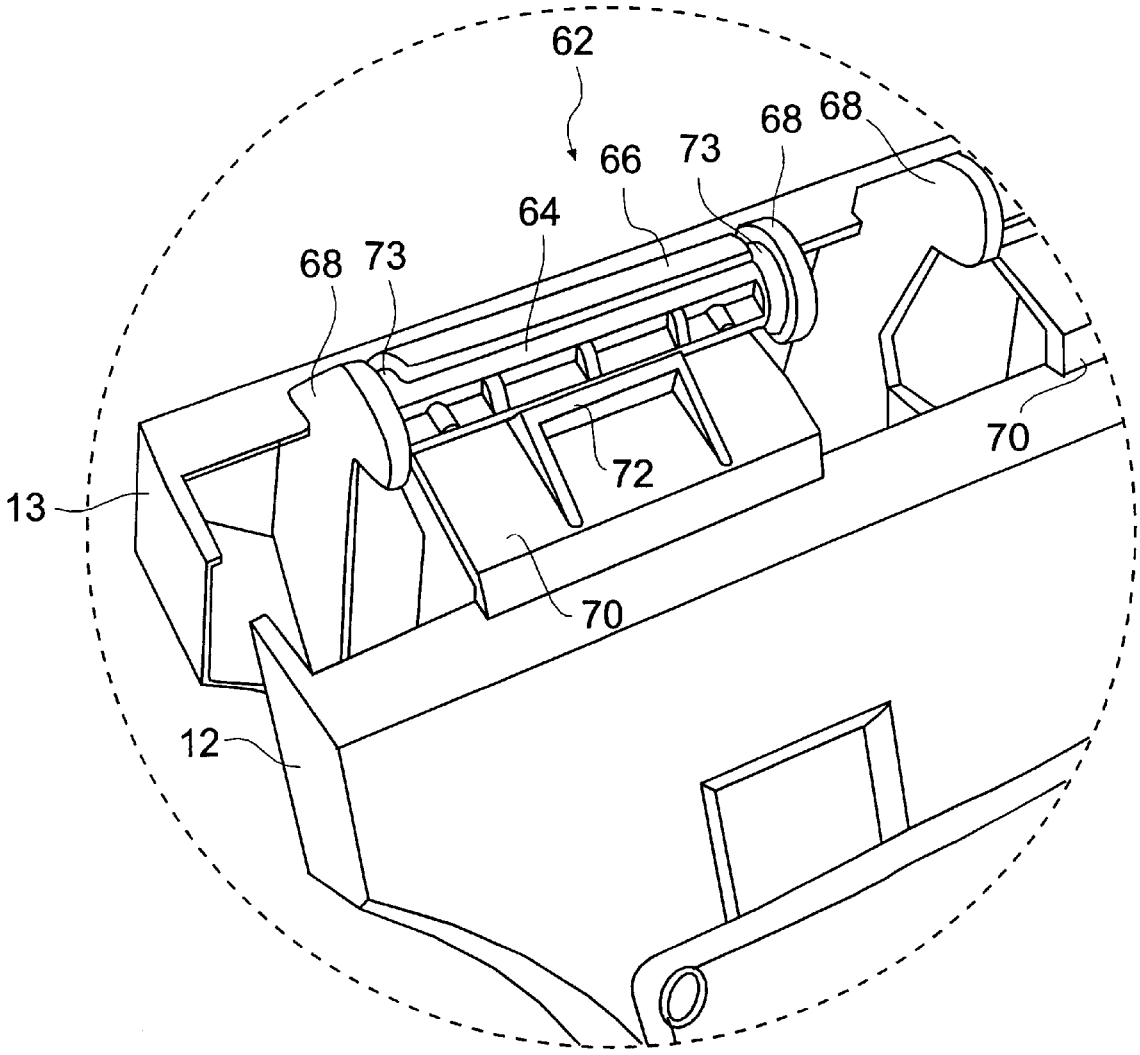
FIG. 11 is a detail view of the hinge structure encircled in FIG. 10.

As noted above, the support members 12, 13 pivot about axis 11. As shown in FIG. 10, a hinge configuration allowing relative pivotal movement between support members 12, 13 includes a series of hinge assemblies 62 spaced along the upper ends of the support members 12, 13. Each hinge assembly 62 comprises a shaft member 64 and an interconnecting journaling member 66, as shown more clearly in FIG. 11. The series of shaft members 64 form the pivot axis 11. Each journaling member 66 partially surrounds the periphery of the associated shaft member 64 to provide a journaling surface therefor. Each shaft portion 64 is joined to the respective support member 12, 13 to which it is attached by a pair of extension members 68, with the distance the shaft portions are spaced above the support members being sufficient for attachment of the cap member 34 and to allow the support members 12, 13 to move into the collapsed position without obstruction. Similarly, the journaling members 66 are attached to the support members 12, 13 by base members 70 and are positioned so as to interconnect with the shaft members 64. As illustrated, each support member has a set of shaft members at one end and a set of journaling members at the other end so that when the identical support members are positioned to face each other and fitted together, the series of shaft members 64 at one end of each support member 12, 13 engages the corresponding series of journaling members of the other one of the support members 12, 13. Each shaft member 64 snaps into interconnecting relation with the associated journaling member 66 and is retained in position by means of a locking member 72 protruding upwardly from the base member 70.

Figure 12:
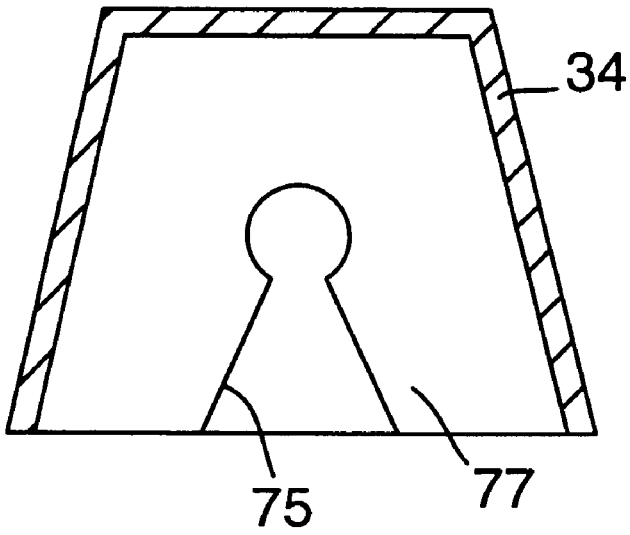
FIG. 12 is a cross sectional view taken through the line 12—12 as indicated in FIG. 1.

The shaft members 64 are slightly wider than the journaling members 66 such that a predetermined length 73 of each of the shaft members 64 remains exposed on either side of the journaling members. The cap member 34 has a plurality of downwardly extending, prong-like or fork-like connecting structures 75 shown in FIG. 12, formed from webs 77 that snap over the exposed lengths of the associated shaft members 64 to hold the cap member 34 in position. The cap member 34 has side walls 74 (FIG. 1) that substantially surround the upper ends of the support members 12, 13, including the hinge assemblies 62, to prevent accidental damage (pinching) to the workpiece or user caused by converging support members 12, 13. The cap member 34 further forms the workpiece supporting surface 14 at an uppermost level of the sawhorse 10.

A number of workpiece supporting structures in the form of supporting pads 76, e.g. four, are positioned within upwardly facing recesses formed within the cap member 34, such that upper portions of the supporting pads 76 protrude slightly above the workpiece supporting surface 14. The supporting pads 76 provide a degree of protection to the workpiece supporting surface 14 from workpieces (and to workpieces from the workpiece supporting surface 14) and reduce slippage of workpieces supported on the workpiece supporting surface 14. Standard and Metric measurement indicia 79 preferably are located on opposite sides of the cap member 34.

Finally, the sawhorse 10 preferably includes one or more foldable cross braces 80. The cross brace 80 comprises a pair of cooperating, extending arms 82, 84 that are each pivotally connected at one end to longitudinal edges of the support members 12, 13. The extending arms 82, 84 are connected to each other at a pin connection 86 that allows relative pivotal movement between the extending arms 82, 84. In the open working position, the extending arms 82, 84 are fully extended, forming a straight path between the pivotal connections at each support member 12, 13 (and defining the maximum pivotal movement of the support members 12, 13) that allows a direct, tensionally and relatively compressively rigid transfer of load between the support members 12, 13. A flange 88 allows a user to manipulate the extending arms 82, 84 easily into a fully extended position (where a stop, not shown, prevents the extending arms 82, 84 from exceeding the fully extended position) and to pull the extending arms 82, 84 out of the fully extended position when collapsing the sawhorse 10.

It will be appreciated that numerous modifications to and departures from the embodiments of the invention described above will occur to those having skill in the art. Such further embodiments are deemed to be within the scope of the following claims.

What is claimed is:

1. A sawhorse, comprising:

a base assembly including a pair of support members each formed from a plastic material, said support members being connected to one another for movement between an open working configuration in which the base assembly is self-supporting in an upright position and a closed storage configuration;

a workpiece support structure mounted on said base assembly and defining an upwardly facing support surface for supporting a workpiece when the base assembly is in the self-supporting upright position thereof; and an attachment for said base assembly in the form of a tool carrier assembly comprising a flexible carrier sheet, a plurality of tool holding elements affixed to said carrier sheet and a plurality of fasteners fixedly affixing said carrier sheet to one of said pair of support members in a configuration providing access to tools held by said tool holding elements when said base assembly is in the open working configuration thereof, the tool carrier assembly being positioned (a) such that the tool carrier assembly is below the workpiece support surface to allow the support surface to support a workpiece without interference from said tool carrier assembly and (b) such that said tool carrier assembly does not impede movement of the base assembly between said closed storage configuration and said open working configuration.

2. A sawhorse as defined in claim 1, wherein said flexible carrier sheet of said tool carrier assembly is constructed of a material comprising at least one of a cloth material, a fabric material, a plastic material, a canvas material, a nylon material and a leather material.

3. A sawhorse as defined in claim 1, wherein said plurality of tool holding elements includes a plurality of tool receiving loops.

4. A sawhorse as defined in claim 3, wherein said plurality of tool holding elements includes a plurality of tool receiving pockets.

5. A sawhorse as defined in claim 1, wherein said flexible carrier sheet is co-extensive with said one support member in at least one dimension thereof.

6. A sawhorse as defined in claim 1, wherein said flexible carrier sheet is affixed to said one support member utilizing rivets.

7. A sawhorse as defined in claim 1, further comprising a cap member constructed of a plastic material mounted on top of said pair of support members, an upwardly facing surface of said cap member providing said workpiece support surface.

8. A sawhorse as defined in claim 7, further comprising a pair of workpiece restraint members, each workpiece restraint member being disposed at a respective opposite end of said workpiece support surface and each workpiece restraint member being movable between (a) a closed position in which each workpiece restraint member is flush with said workpiece support surface and (b) an upright position in which each workpiece restraint member extends upwardly from a respective end of said workpiece support surface, said workpiece restraint members being constructed and arranged in the upright positions thereof to provide opposing vertically extending workpiece restraint surfaces at opposite ends of said workpiece support surface to guide and stabilize a workpiece thereon.

9. A sawhorse as defined in claim 8, wherein said workpiece restraint members in the closed positions thereof are disposed in respective recesses formed in said workpiece support surface.

10. A sawhorse as defined in claim 1, further comprising a plurality of workpiece supporting structures disposed on said workpiece support surface, each workpiece supporting structure being constructed and arranged to reduce slippage of a workpiece along the workpiece support surface.

11. A sawhorse as defined in claim 10, wherein each said workpiece supporting structure is constructed of a rubber material.

12. A sawhorse as defined in claim 1, further comprising a plurality of non-skid members disposed on bottom edges of said base assembly, said non-skid members being constructed and arranged to resist sliding of the base assembly along a surface on which the base assembly is supported in the upright position thereof.

13. A sawhorse as defined in claim 12, wherein each said non-skid member is comprise of a rubber material.

14. A sawhorse as defined in claim 1, wherein each support member of said pair of support members includes two legs and wherein said flexible carrier sheet is fixedly affixed to said legs of said one support member.

15. A sawhorse of claim 1, wherein each support member of said pair of support members includes a pair of legs and at least one cross-brace extending between the legs thereof, and wherein said flexible carrier sheet is fixedly affixed to said cross-brace of said one support member.

16. A sawhorse as defined in claim 1, further comprising a latch member constructed and arranged to secure the pair of support members in the closed storage configuration thereof.

17. A sawhorse as defined in claim 1, further comprising measurement indicia disposed thereon.

18. A sawhorse as defined in claim 1, wherein said first and second support members are identical to one another.

* * * * *